US012502001B2

(12) United States Patent
Wu

(10) Patent No.: US 12,502,001 B2
(45) Date of Patent: Dec. 23, 2025

(54) FOLDING BED

(71) Applicant: GoPlus Corp., Fontana, CA (US)

(72) Inventor: Wei Wu, Fontana, CA (US)

(73) Assignee: GoPlus Corp., Fontana, CA (US)

( * ) Notice: Subject to any disclaimer, the term of this patent is extended or adjusted under 35 U.S.C. 154(b) by 46 days.

(21) Appl. No.: 18/648,358

(22) Filed: Apr. 27, 2024

(65) Prior Publication Data

US 2025/0331649 A1 Oct. 30, 2025

(51) Int. Cl.
*A47C 19/12* (2006.01)
*A47C 19/02* (2006.01)

(52) U.S. Cl.
CPC ..... *A47C 19/122* (2013.01); *A47C 19/024* (2013.01); *A47C 19/025* (2013.01)

(58) Field of Classification Search
CPC ... A47C 19/122; A47C 19/025; A47C 19/024; A47C 17/70; A47C 19/02; A47C 19/12; A47C 17/72; A47C 17/74; A47C 19/005; A47C 19/021; A47C 19/028; A47C 19/126; A47C 21/00; A61G 7/012; A61G 7/002; A61G 7/015
USPC ..... 5/154, 152, 174, 180
See application file for complete search history.

(56) References Cited

U.S. PATENT DOCUMENTS 1,541,105 A * 6/1925 Broome ..... A47C 19/122 5/151
2,773,269 A * 12/1956 Holt ..... A47C 19/122 5/152
4,048,683 A * 9/1977 Chen ..... A47C 19/122 5/174
2019/0045938 A1* 2/2019 Skaggs ..... A47C 19/122

FOREIGN PATENT DOCUMENTS

EP 3936005 A1 * 1/2022 ..... A47C 19/122

* cited by examiner

*Primary Examiner* — Madison Emanski

(57) ABSTRACT

The disclosure relates to the technical field of folding beds, disclosing a folding bed, which includes a bed plate support frame and bed leg support frames disposed at lower ends of the bed plate support frame. The bed plate support frame includes a fixed support frame and side support frames, each bed leg support frame includes a first bed leg support frame and a second bed leg support frame. When the folding bed needs to be stored, the side support frames are upwards turned and folded relatively to the fixed support frame. In this process, the second bed leg support frames are driven to be turned and folded through the transmission rods, which do not need to be singly folded, so the use is convenient, and the labor is saved. After being folded, the folding bed occupies a small space, and is convenient to store and carry.

11 Claims, 10 Drawing Sheets

FOLDING BED

TECHNICAL FIELD

The disclosure relates to the technical field of folding beds, and particularly relates to a folding bed.

BACKGROUND

Due to its characteristic of foldability, a folding bed is convenient for a user to use, and has been more and more widely used. Some existing folding beds include halfly foldable bed plates and bed legs supported on the ground, and the bed legs include bed legs at inner sides and bed legs at outer sides. When such a folding bed needs to be folded, the bed plates need to be folded in half, then, bed leg portions at the outer side are singly folded, folding steps are many, and the labor is wasted during operation. Additionally, after the folding bed is folded, the size of the bed is generally still big, and the storage and carrying are inconvenient.

SUMMARY

(I) Technical Problems to be Solved

The disclosure aims at solving the problems to provide a folding bed. Second bed leg support frames do not need to be singly folded during storage, the use is convenient, and the labor is saved. After being folded, the folding bed occupies a small space, and is convenient to store and carry.

(II) Technical Solution

In order to solve the technical problems, the disclosure provides a folding bed, including a bed plate support frame and bed leg support frames disposed at lower ends of the bed plate support frame, the bed plate support frame includes a fixed support frame and side support frames, one end of each of the side support frames is hinged and connected to side ends of the fixed support frame and forms first hinging points so that the side support frames rotate relatively to the fixed support frame around the first hinging points, each of the bed leg support frames includes a first bed leg support frame and a second bed leg support frame, the first bed leg support frame is connected onto the fixed support frame, the second bed leg support frame is hinged and connected onto the corresponding side support frame, transmission rods are connected between the first bed leg support frame and the second bed leg support frame, one end of each of the transmission rods is hinged to the first bed leg support frame, and the other end of each of the transmission rods is hinged to the second bed leg support frame. When the side support frames are driven by external force to be upwards turned and folded relatively to the fixed support frame, the transmission rods drive the second bed leg support frames to be turned and folded relatively to the side support frames. When the folding bed according to the disclosure needs to be stored, the side support frames are upwards turned and folded relatively to the fixed support frame. In this process, the second bed leg support frames are driven to be turned and folded through the transmission rods, and the second bed leg support frames do not need to be singly folded, so the use is convenient, and the labor is saved. After being folded, the folding bed occupies a small space, and is convenient to store and carry.

Further, second hinging points are formed between the second bed leg support frame and the side support frame, the second bed leg support frame rotates relatively to the side support frame around the second hinging points, a third hinging point is formed between one end of each of the transmission rods and the corresponding second bed leg support frame, and one end of each of the transmission rods rotates relatively to the second bed leg support frame around the third hinging points.

Further, a first screw bolt is disposed at each of the first hinging points, a second screw bolt is disposed at each of the second hinging points, and a third screw bolt is disposed at each of the third hinging points.

Further, each of the first bed left support frames and the second bed leg support frames is respectively in a U shape.

Further, universal wheels are detachably disposed at the bottom of each of the first bed leg support frames, and anti-slip pads are disposed at the bottom of each of the second bed leg support frames.

Further, the two side support frames are symmetrically disposed, and the two side support frames are respectively hinged to two sides of the fixed support frame.

Further, the two first bed leg support frames are symmetrically disposed, and the two first bed leg support frames are respectively hinged to the two sides of the fixed support frame, and connection posts are detachably connected between the two first bed leg support frames through fifth screw bolts.

Further, the upper side of one end of each of the side support frames far away from the fixed support frame is detachably provided with a U-shaped frame through fourth screw bolts.

Further, each of the side support frames includes a first net frame and a second net frame, one end of the first net frame is hinged to one end of the fixed support frame through first screw bolts, and the other end of the first net frame is hinged to one end of the second net frame through sixth screw bolts.

Further, one end of each of the first net frames near the corresponding second net frame is fixedly provided with limiting sleeves, one end of each of the second net frames near the corresponding first net frame is provided with installing rods, one end of each of the installing rods is disposed in the corresponding limiting sleeve, each of the limiting sleeves is downwards protruded to be provided with a first hinging plate, one end of each of the installing rods is downwards protruded to be provided with a second hinging plate, and the first hinging plate and the corresponding second hinging plate are hinged through the corresponding sixth screw bolt.

Further, a manual screw bolt is connected onto each of the limiting sleeves through screw threads, a screw bolt hole corresponding to the manual screw bolt is formed on each of the limiting sleeves, an installing hole corresponding to the corresponding manual screw bolt is formed on each of the installing rods, and each of the manual screw bolt sequentially penetrates through the corresponding screw bolt hole and the corresponding installing hole.

Further, an avoiding groove corresponding to the corresponding first hinging plate is formed on each of the transmission rods.

Further, the avoiding groove is in an arc shape.

(III) Beneficial Effects

When the folding bed according to the disclosure needs to be stored, the side support frames are upwards turned and folded relatively to the fixed support frame. In this process, the second bed leg support frames are driven to be turned and folded through the transmission rods, and the second bed leg support frames do not need to be singly folded, so the use is convenient, and the labor is saved. After being folded, the folding bed occupies a small space, and is convenient to store and carry. The first screw bolt is disposed at each of the first hinging points, the second screw bolt is disposed at each of the second hinging points, and the third screw bolt is disposed at each of the third hinging points, so the structure is simple, and the production cost is low. A screw bolt manner is adopted, the mounting and dismounting are convenient, and the assembly cost is lowered. The upper side of one end of each of the side support frames far away from the fixed support frame is detachably provided with a U-shaped frame through the fourth screw bolts, the U-shaped frames achieve the effect of a guardrail to enhance the safety. At the same time, when the side support frames are folded, the U-shaped frames may be used as handles to assist the side support frame folding. In a first storage state, the transmission rods are dismounted, and then, the second net frames are downwards and outwards folded to reach a second folding state. The storage height is further reduced, and the occupied space is further reduced. The avoiding groove corresponding to the corresponding first hinging plate is formed on each of the transmission rods, and the avoiding groove is in an arc shape, so that the interference between the transmission rod and the first hinging plate is avoided, and the structural design is reasonable.

Figure 1:
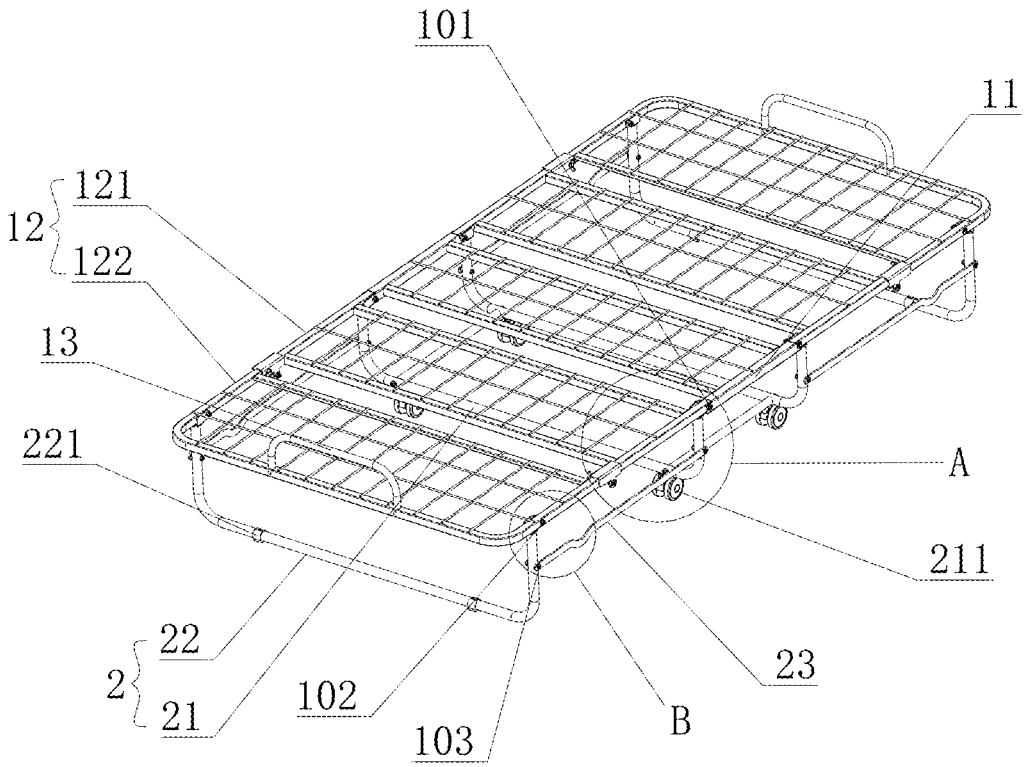
FIG. 1 is a three-dimensional diagram of a folding bed according to the disclosure in an unfolded use state.

In the figures, 101 denotes a first hinging point, 102 denotes a second hinging point, 103 denotes a third hinging point, 2 denotes a bed leg support frame, 21 denotes a first bed leg support frame, 211 denotes a universal wheel, 221 denotes an anti-slip pad, 22 denotes a second bed leg support frame, 23 denotes a transmission rod, 231 denotes an avoiding groove, 31 denotes a first screw bolt, 32 denotes a second screw bolt, 33 denotes a third screw bolt, 34 denotes a fourth screw bolt, 35 denotes a fifth screw bolt, 36 denotes a sixth screw bolt, 37 denotes a seventh screw bolt, 4 denotes a first hinging plate, 5 denotes a limiting sleeve, 501 denotes a screw bolt hole, 6 denotes an installing rod, 61 denotes a second hinging plate, 601 denotes an installing hole, 7 denotes a manual screw bolt, 11 denotes a fixed support frame, 12 denotes a side support frame, 121 denotes a first net frame, 122 denotes a second net frame, 13 denotes a U-shaped frame, and 8 denotes a connection post.

DETAILED DESCRIPTION

Specific implementations of the disclosure will be further described in detail hereafter in conjunction with the accompanying drawings and examples. The following examples are only for purposes of illustration and are not intended to limit the scope of the disclosure.

Referring to FIG. 1 to FIG. 10, the disclosure provides a folding bed, including a bed plate support frame and bed leg support frames 2 disposed at lower ends of the bed plate support frame. The bed plate support frame includes a fixed support frame 11 and side support frames 12, one end of each of the side support frames 12 is hinged and connected to side ends of the fixed support frame 11 and forms first hinging points 101 so that the side support frames 12 rotate relatively to the fixed support frame 11 around the first hinging points 101, each of the bed leg support frames 2 includes a first bed leg support frame 21 at the inner side and a second bed leg support frame 22 at the outer side, the first bed leg support frame 21 is connected onto the fixed support frame 11, the second bed leg support frame 22 is hinged and connected onto the corresponding side support frame 12, transmission rods 23 are connected between the first bed leg support frame 21 and the second bed leg support frame 22, one end of each of the transmission rods 23 is hinged to the first bed leg support frame 21 through a seventh screw bolt 37, and the other end of each of the transmission rods 23 is hinged to the second bed leg support frame 22. When the folding bed is folded to be stored, i.e., when the side support frames 12 are driven by external force to be upwards turned and folded relatively to the fixed support frame 11, the transmission rods 23 drive the second bed leg support frames 22 to be turned and folded relatively to the side support frames 12. When the folding bed according to the disclosure needs to be stored, the side support frames are upwards turned and folded relatively to the fixed support frame. In this process, the second bed leg support frames may be driven to be turned and folded through the transmission rods, and the second bed leg support frames do not need to be singly folded, so the use is convenient, and the labor is saved. After being folded, the folding bed occupies a small space, and is convenient to store and carry. A normal state of the folding bed is an unfolded use state. The first bed leg support frames 21 and the second bed leg support frames 22 are all in a vertical state, and the fixed support frame 11 and the side support frames 12 are all parallel to the ground.

Figure 2:
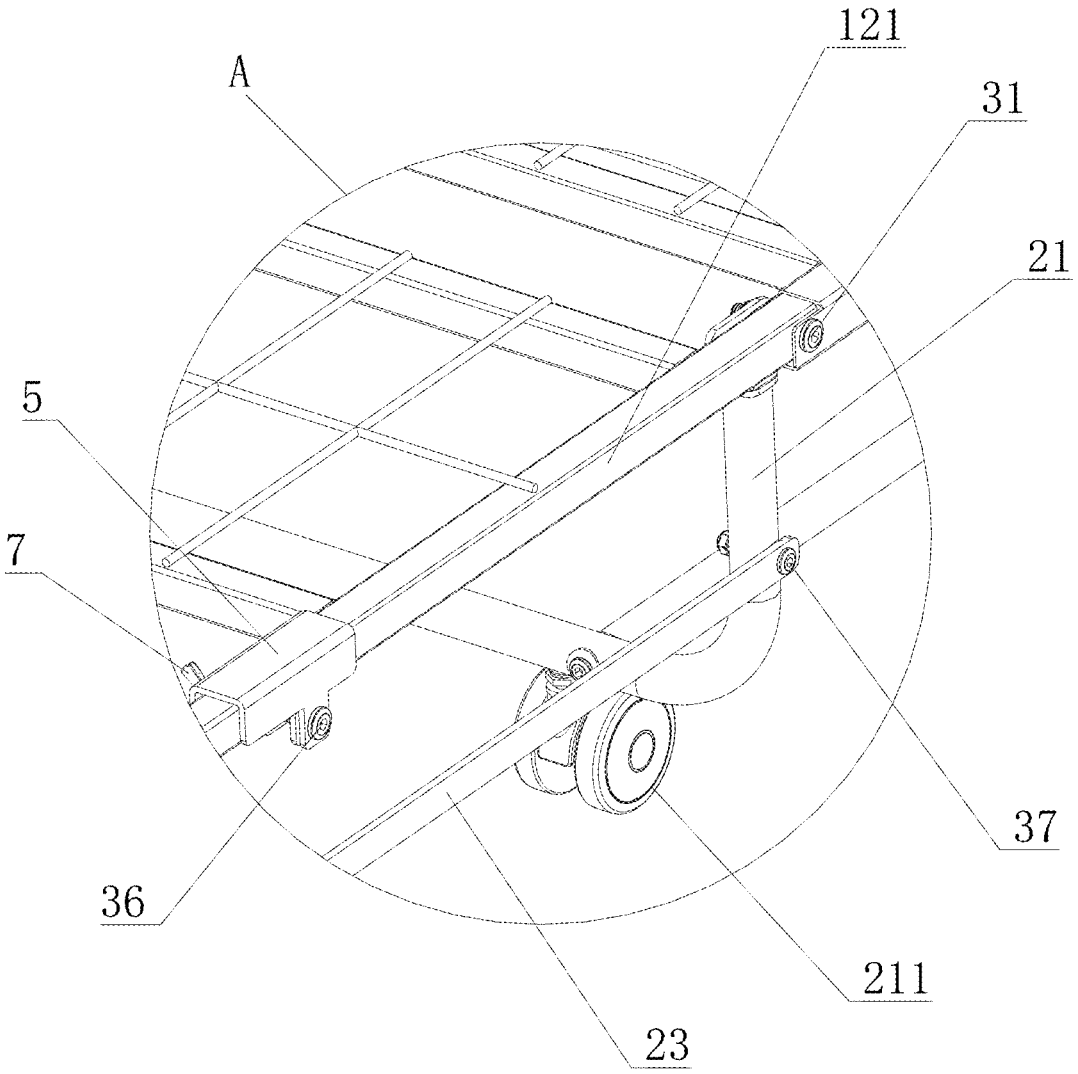
FIG. 2 is an enlarged view of a portion A in FIG. 1.
Figure 3:
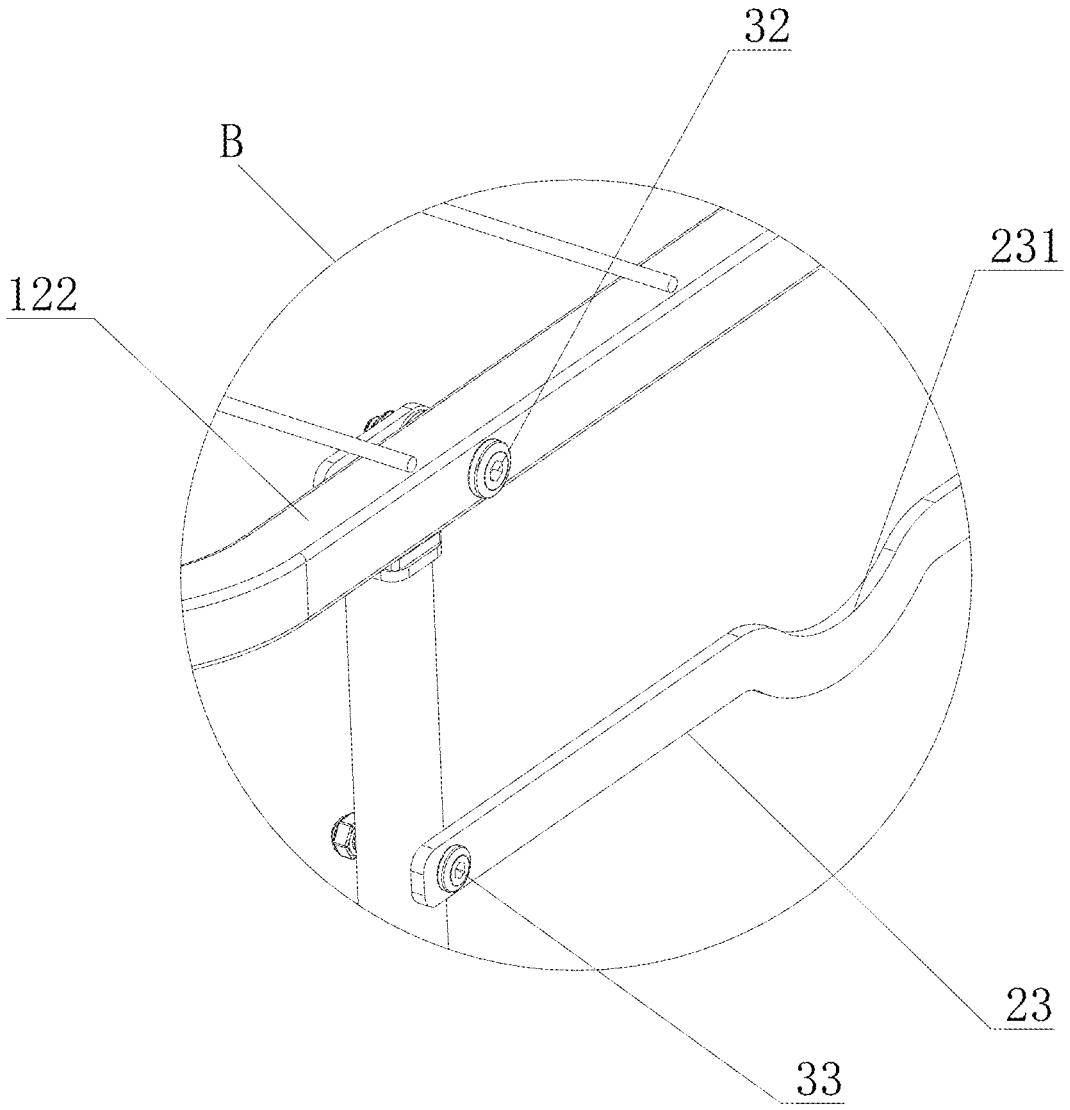
FIG. 3 is an enlarged view of a portion B in FIG. 1.

Referring to FIG. 1 to FIG. 3, second hinging points 102 are formed between the second bed leg support frame 22 and the side support frame 12, the second bed leg support frame 22 rotates relatively to the side support frame 12 around the second hinging points 102, a third hinging point 103 is formed between one end of each of the transmission rods 23 and the corresponding second bed leg support frame 22, and one end of each of the transmission rods 23 rotates relatively to the second bed leg support frame 22 around the third hinging points 103. A first screw bolt 31 is disposed at each of the first hinging points 101, a second screw bolt 32 is disposed at each of the second hinging points 102, and a third screw bolt 33 is disposed at each of the third hinging points 103. The structure is simple, and the production cost is low. A screw bolt manner is adopted, the mounting and dismounting are convenient, and the assembly cost is lowered. The first screw bolts 31, the second screw bolts 32 and the third screw bolts 33 are fixed by using corresponding screw caps. Each of the first bed left support frames 21 and the second bed leg support frames 22 is respectively in a U shape, and the support is stable and firm.

Figure 4:
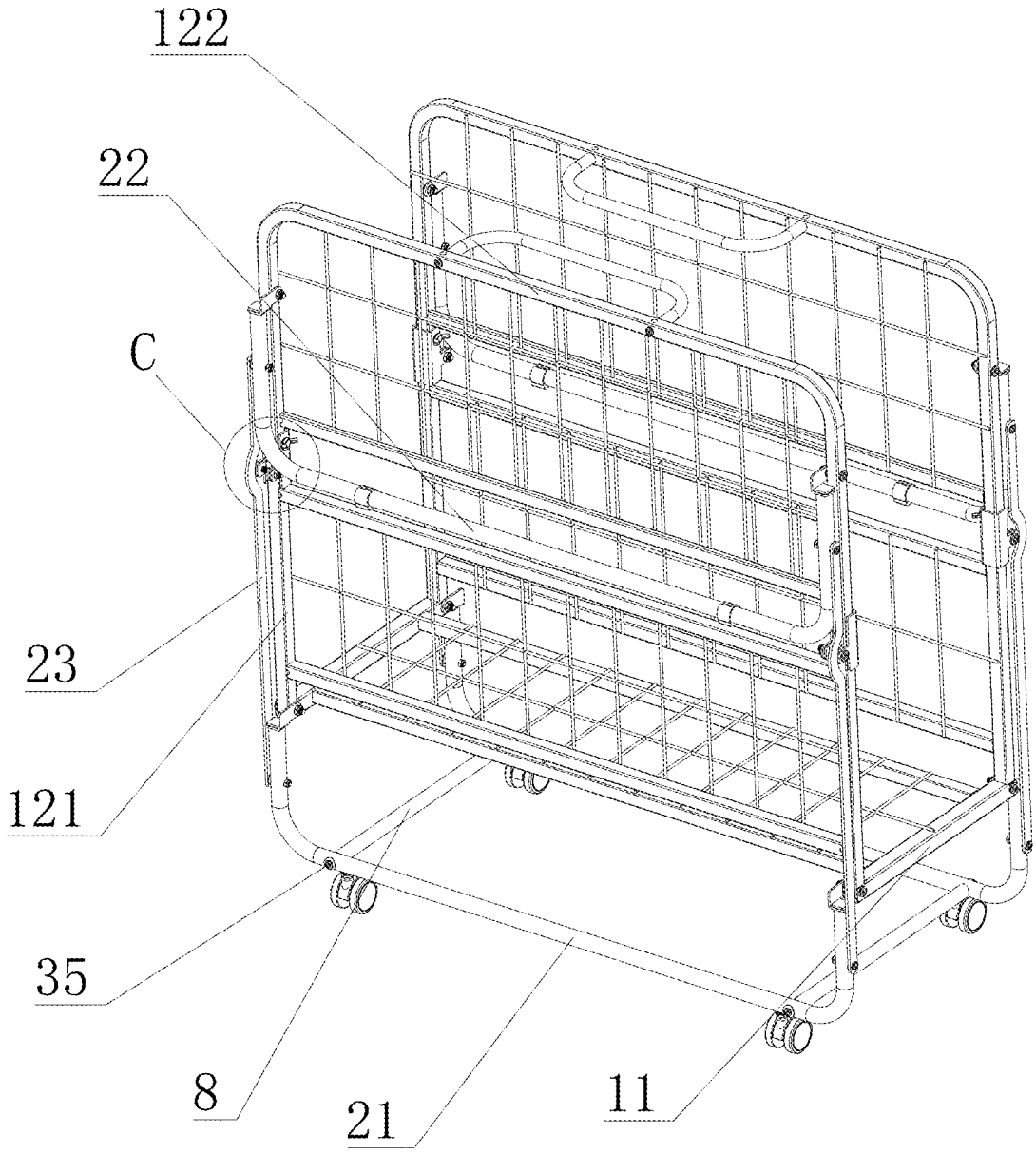
FIG. 4 is a schematic structure diagram of a folding bed according to the disclosure in a first storage state.
Figure 5:
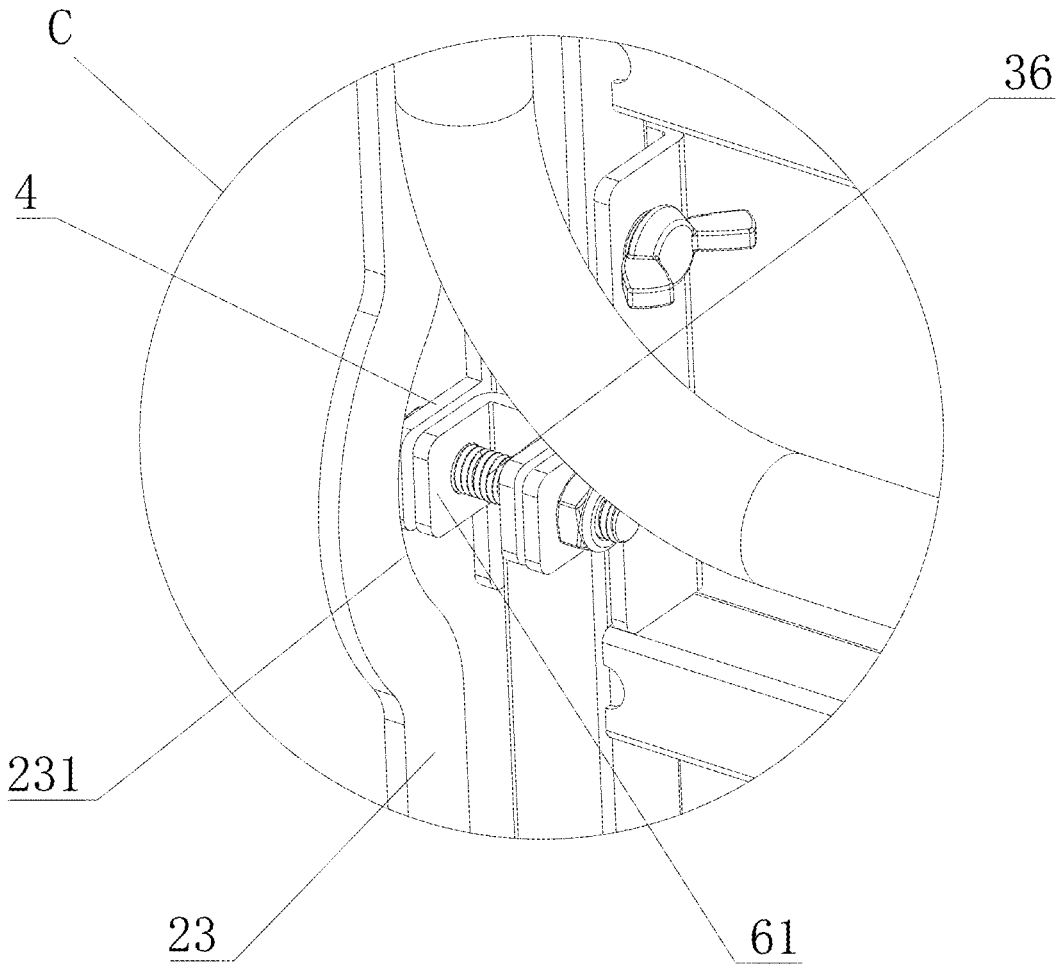
FIG. 5 is an enlarged view of a portion C in FIG. 4.

Referring to FIG. 1, universal wheels 211 are detachably disposed at the bottom of each of the first bed leg support frames 21, so that the folding bed may be conveniently moved in a folded state. Anti-slip pads 221 are disposed at the bottom of each of the second bed leg support frames 22, so that the folding bed cannot easily slip in an unfolded use state. The anti-slip pads 221 are made of rubber, silica gel or plastic materials. The two side support frames 12 are symmetrically disposed, and the two side support frames 12 are respectively hinged to two sides of the fixed support frame 11. Referring to FIG. 4, when the folding bed is folded, the two side support frames 12 are both upwards folded to the vertical state. After the folding, the occupied area is reduced, and this state is the first storage state.

Referring to FIG. 1 to FIG. 7, the two first bed leg support frames 21 are symmetrically disposed, and the two first bed leg support frames 21 are respectively hinged to the two sides of the fixed support frame 11, and connection posts 8 are detachably connected between the two first bed leg support frames 21 through fifth screw bolts 35. The connection posts 8 are detachably disposed, so that after the connection posts 8 are dismounted, the two first bed leg support frames 21 can be conveniently inwards folded, and the storage size is further reduced.

Figure 8:
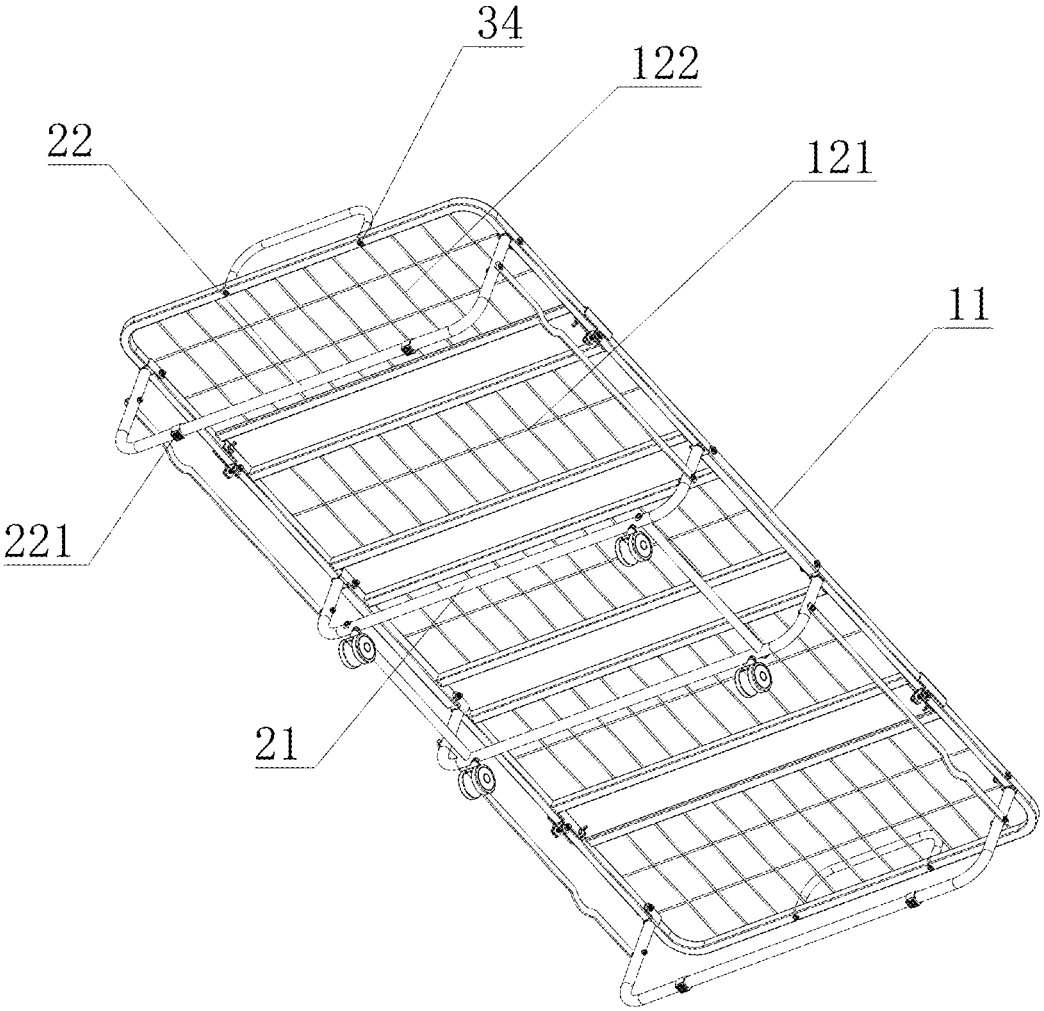
FIG. 8 is a schematic structure diagram of a bottom of a folding bed according to the disclosure.
Figure 9:
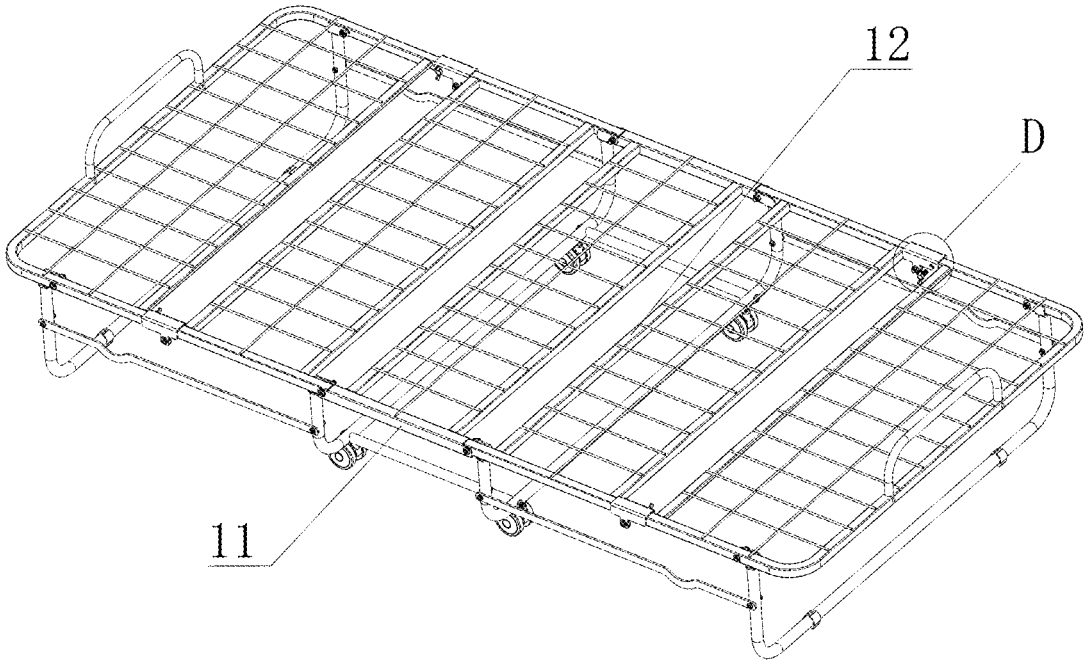
FIG. 9 is a schematic structure diagram of a folding bed according to the disclosure when a manual screw bolt is dismounted.
Figure 10:
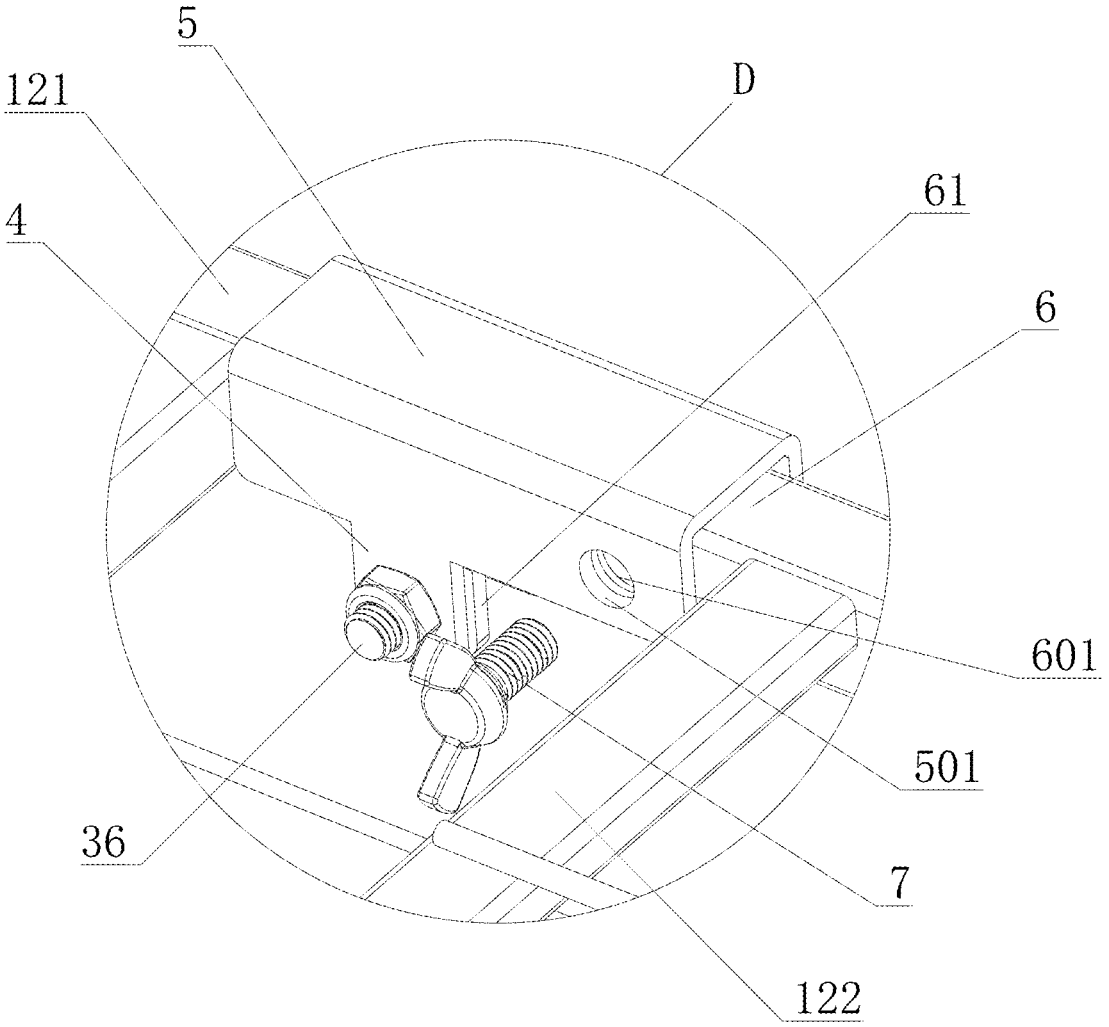
FIG. 10 is an enlarged view of a portion D in FIG. 9.

Referring to FIG. 1 and FIG. 8, the upper side of one end of each of the side support frames 12 far away from the fixed support frame 11 is detachably provided with a U-shaped frame 13 through fourth screw bolts 34. The U-shaped frame 13 achieves the effect of a guardrail to enhance the safety. At the same time, when the side support frames 12 are folded, the U-shaped frame 13 may be used as a handle to assist the folding of the side support frames 12.

Referring to FIG. 1 to FIG. 5, each of the side support frames 12 includes a first net frame 121 and a second net frame 122, one end of the first net frame 121 is hinged to one end of the fixed support frame 11 through first screw bolts 31, and the other end of the first net frame 121 is hinged to one end of the second net frame 122 through sixth screw bolts 36. In the first storage state, the transmission rods 23 are dismounted, then, the second net frames 122 are downwards turned to form a second storage state, the storage height is further reduced, and the occupied space is reduced.

Figure 6:
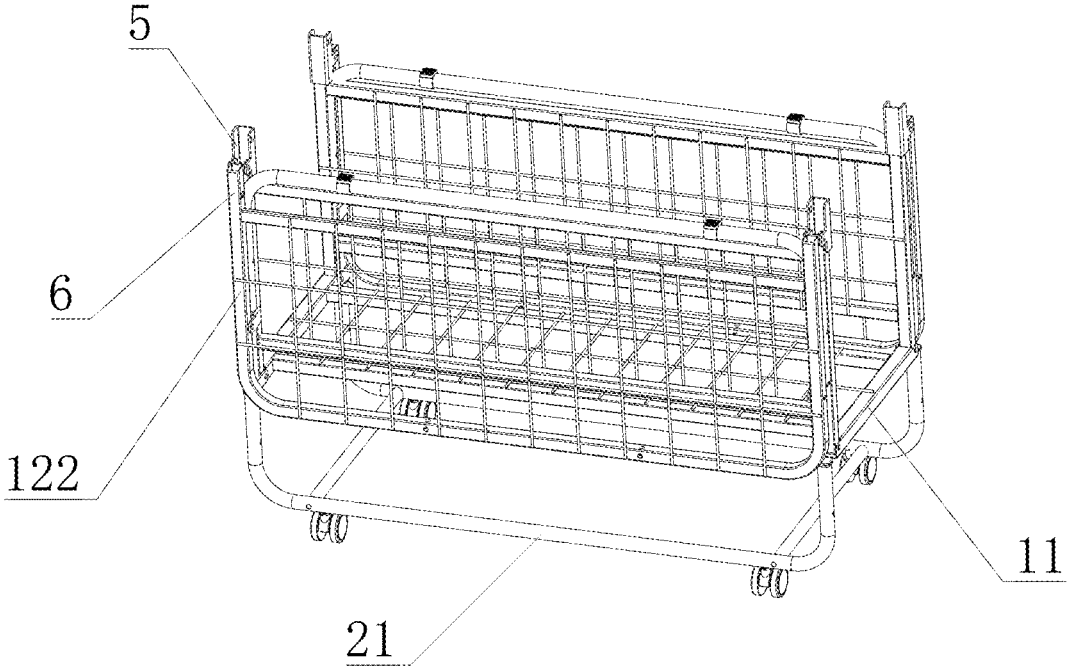
FIG. 6 is a schematic structure diagram of a folding bed according to the disclosure in a second storage state.
Figure 7:
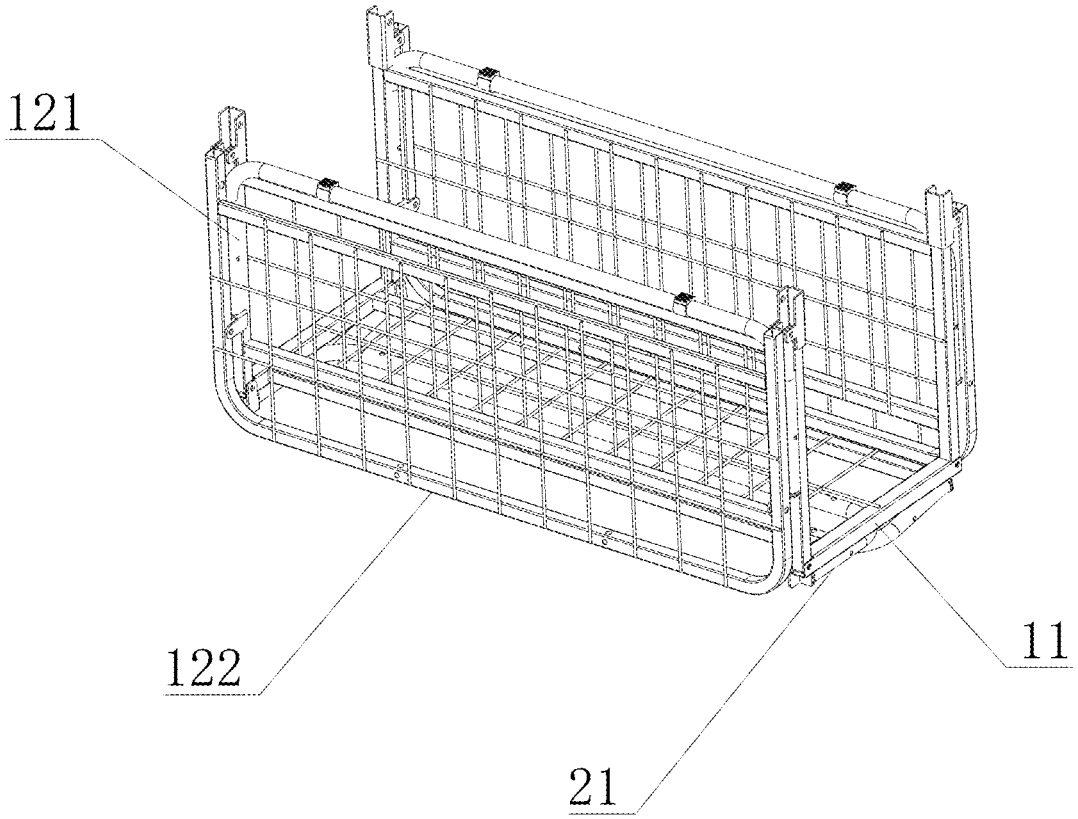
FIG. 7 is a schematic structure diagram of a folding bed according to the disclosure in a third storage state.

Referring to FIG. 1, FIG. 4, FIG. 5, FIG. 9 and FIG. 10, one end of each of the first net frames 121 near the corresponding second net frame 122 is fixedly provided with limiting sleeves 5 through welding, one end of each of the second net frames 122 near the corresponding first net frame 121 is provided with installing rods 6, and one end of each of the installing rods 6 is disposed in the corresponding limiting sleeve 5. Therefore, in the unfolded use state, the installing rod 6 is limited in the corresponding limiting sleeve 5. At this moment, the first net frames 121 and the second net frames 122 are all parallel to the ground. Each of the limiting sleeves 5 is downwards protruded to be provided with a first hinging plate 4, one end of each of the installing rods 6 is downwards protruded to be provided with a second hinging plate 61, and the first hinging plate 4 and the corresponding second hinging plate 61 are hinged through the corresponding sixth screw bolt 36. The mounting and the dismounting are convenient. A manual screw bolt 7 is connected onto each of the limiting sleeves 5 through screw threads, a screw bolt hole 501 corresponding to the manual screw bolt 7 is formed on each of the limiting sleeves 5, an installing hole 601 corresponding to the corresponding manual screw bolt 7 is formed on each of the installing rods 6, and each of the manual screw bolts 7 sequentially penetrates through the corresponding screw bolt hole 501 and the corresponding installing hole 601. When the folding bed is in the folded use state, the first net frames 121 and the second net frames 122 are limited and fixed through the manual screw bolts 7. When the folding bed is folded to the first storage state, the transmission rods and the manual screw bolts 7 are dismounted to fold the folding bed to the second storage state. An avoiding groove 231 corresponding to the corresponding first hinging plate 4 is formed on each of the transmission rods 23. The avoiding groove 231 is in an arc shape, so that the interference between the transmission rod 23 and the first hinging plate 4 is avoided, and the structural design is reasonable. Referring to FIG. 6, when the folding bed is in the second storage state, referring to FIG. 7, all of the universal wheels 211 and connection posts 8 are dismounted, at this moment, the first bed leg support frames 21 are inwards folded to achieve a third storage state, and the storage size is further reduced.

In the folding bed according to the disclosure, the avoiding groove corresponding to the corresponding first hinging plate is formed on each of the transmission rods, and the avoiding groove is in an arc shape, so that the interference between the transmission rod and the first hinging plate is avoided, and the structural design is reasonable. During storage, the side support frames are upwards turned and folded relatively to the fixed support frame, in this process, the second bed leg support frames may be driven through the transmission rods to be turned and folded, and the second bed leg support frames do not need to be singly folded, so the use is convenient, and the labor is saved. After being folded, the folding bed occupies a small space, and is convenient to store and carry. The first screw bolt is disposed at each of the first hinging points, the second screw bolt is disposed at each of the second hinging points, and the third screw bolt is disposed at each of the third hinging points. The structure is simple, and the production cost is low. A screw bolt manner is adopted, the mounting and dismounting are convenient, and the assembly cost is lowered. The upper side of one end of each of the side support frames far away from the fixed support frame is detachably provided with a U-shaped frame through fourth screw bolts, and the U-shaped frames achieve the effect of a guardrail to enhance the safety. At the same time, when the side support frames are folded, the U-shaped frames may be used as handles to assist the side support frame folding. In the first storage state, the transmission rods are dismounted, then, the second net frames are downwards and outwards folded to reach a second folding state. The storage height is further reduced, and the occupied space is further reduced.

The above descriptions are merely exemplary implementations of the disclosure. It should be pointed out that those of ordinary skill in the art may further make various improvements and modifications without departing from the technical principles of the disclosure, and these improvements and modifications shall also be within the protection scope of the disclosure.

What is claimed is:

1. A folding bed, comprising a bed plate support frame and bed leg support frames (2) disposed at lower ends of the bed plate support frame, wherein the bed plate support frame comprises a fixed support frame (11) and side support frames (12), one end of each of the side support frames (12) is hinged and connected to side ends of the fixed support frame (11) and forms first hinging points (101) so that the side support frames (12) rotate relatively to the fixed support frame (11) around the first hinging points (101), each of the bed leg support frames (2) comprises a first bed leg support frame (21) and a second bed leg support frame (22), the first bed leg support frame (21) is connected onto the fixed support frame (11), the second bed leg support frame (22) is hinged and connected onto the corresponding side support frame (12), transmission rods (23) are connected between the first bed leg support frame (21) and the second bed leg support frame (22), one end of each of the transmission rods (23) is hinged to the first bed leg support frame (21), and the other end of each of the transmission rods (23) is hinged to the second bed leg support frame (22); and when the side support frames (12) are driven by external force to be upwards turned and folded relatively to the fixed support frame (11), the transmission rods (23) drive the second bed leg support frames (22) to be turned and folded relatively to the side support frames (12);

wherein the two side support frames (12) are symmetrically disposed, and the two side support frames (12) are respectively hinged to two sides of the fixed support frame (11); and wherein the two first bed leg support frames (21) are symmetrically disposed, and the two first bed leg support frames (21) are respectively hinged to the two sides of the fixed support frame (11), and connection posts (8) are detachably connected between the two first bed leg support frames (21) through screw bolts (35).

2. The folding bed according to claim 1, wherein second hinging points (102) are formed between the second bed leg support frame (22) and the side support frame (12), the second bed leg support frame (22) rotates relatively to the side support frame (12) around the second hinging points (102), a third hinging point (103) is formed between one end of each of the transmission rods (23) and the corresponding second bed leg support frame (22), and one end of each of the transmission rods (23) rotates relatively to the second bed leg support frame (22) around the third hinging points (103).

3. The folding bed according to claim 2, wherein a first screw bolt (31) is disposed at each of the first hinging points (101), a second screw bolt (32) is disposed at each of the second hinging points (102), and a third screw bolt (33) is disposed at each of the third hinging points (103).

4. The folding bed according to claim 1, wherein each of the first bed left support frames (21) and the second bed leg support frames (22) is respectively in a U shape.

5. The folding bed according to claim 1, wherein universal wheels (211) are detachably disposed at the bottom of each of the first bed leg support frames (21), and anti-slip pads (221) are disposed at the bottom of each of the second bed leg support frames (22).

6. The folding bed according to claim 1, wherein the upper side of one end of each of the side support frames (12) far away from the fixed support frame (11) is detachably provided with a U-shaped frame (13) through additional screw bolts (34).

7. The folding bed according to claim 1, wherein each of the side support frames (12) comprises a first net frame (121) and a second net frame (122), one end of the first net frame (121) is hinged to one end of the fixed support frame (11) through first additional screw bolts (31), and the other end of the first net frame (121) is hinged to one end of the second net frame (122) through second additional screw bolts (36).

8. The folding bed according to claim 7, wherein one end of each of the first net frames (121) adjacent to the corresponding second net frame (122) is fixedly provided with limiting sleeves (5), one end of each of the second net frames (122) adjacent to the corresponding first net frame (121) is provided with installing rods (6), one end of each of the installing rods (6) is disposed in the corresponding limiting sleeve (5), each of the limiting sleeves (5) is downwards protruded to be provided with a first hinging plate (4), one end of each of the installing rods (6) is downwards protruded to be provided with a second hinging plate (61), and the first hinging plate (4) and the corresponding second hinging plate (61) are hinged through a corresponding one of the second additional screw bolts (36).

9. The folding bed according to claim 8, wherein a manual screw bolt (7) is connected onto each of the limiting sleeves (5) through screw threads, a screw bolt hole (501) corresponding to the manual screw bolt (7) is formed on each of the limiting sleeves (5), an installing hole (601) corresponding to the corresponding manual screw bolt (7) is formed on each of the installing rods (6), and each of the manual screw bolt (7) sequentially penetrates through the corresponding screw bolt hole (501) and the corresponding installing hole (601).

10. The folding bed according to claim 8, wherein an avoiding groove (231) corresponding to the corresponding first hinging plate (4) is formed on each of the transmission rods (23).

11. The folding bed according to claim 10, wherein the avoiding groove (231) is in an arc shape.

* * * * *